United States Patent [19]

Murata et al.

[11] Patent Number: 5,012,752

[45] Date of Patent: May 7, 1991

[54] WORK PIECE SETTING APPARATUS WITH PATTERN MATCHING

[75] Inventors: Kunihiko Murata, Tsushima; Satoshi Morii, Nagoya; Hiroyuki Mitsui, Kasugai; Toru Takemura, Nagoya; Toshiaki Iwasaki, Nagoya; Takaaki Suzuki, Nagoya, all of Japan

[73] Assignee: Brother Kogyo Kabushiki Kaisha, Aichi, Japan

[21] Appl. No.: 371,057

[22] Filed: Jun. 26, 1989

[30] Foreign Application Priority Data

Jun. 27, 1988 [JP] Japan ..... 63-158758

[51] Int. Cl.[5] ..... D05B 21/00

[52] U.S. Cl. ..... 112/121.12; 112/104; 271/227

[58] Field of Search ..... 112/121.12, 121.11, 112/306, 311, 314, 308, 309, 121.15, 104; 271/227; 270/58; 364/559, 470; 382/41

[56] References Cited

U.S. PATENT DOCUMENTS

| | | | |
|---|---|---|---|
| 3,528,378 | 9/1970 | Westhoff | 112/121.15 |
| 3,552,336 | 1/1971 | Brandriff et al. | 112/121.15 |
| 4,435,837 | 3/1984 | Abernathy | 112/121.12 X |
| 4,498,404 | 2/1985 | Sadeh | 112/121.12 |
| 4,612,867 | 9/1986 | Rosch et al. | 112/314 |
| 4,757,773 | 7/1988 | Nomura et al. | 112/121.11 |
| 4,766,828 | 8/1988 | Nomura et al. | 112/314 |
| 4,776,579 | 10/1988 | Romand et al. | 271/227 X |
| 4,777,896 | 10/1988 | Nomura | 112/314 |
| 4,785,749 | 11/1988 | Fischer | 112/121.12 |
| 4,821,659 | 4/1989 | Morii et al. | 112/121.15 |
| 4,867,087 | 9/1989 | Suzuki et al. | 112/121.11 X |

FOREIGN PATENT DOCUMENTS

| | | |
|---|---|---|
| 2056776 | 6/1979 | United Kingdom . |
| 2128772 | 10/1982 | United Kingdom . |
| 2139348 | 3/1983 | United Kingdom . |
| 2197349 | 11/1986 | United Kingdom . |

*Primary Examiner*—Peter Nerbun

*Attorney, Agent, or Firm*—Oliff & Berridge

[57] ABSTRACT

A work piece setting apparatus including a sensor for detecting patterns of two work pieces, two holders for holding the cloth pieces, a moving device for moving the lower holder, a rotator for rotating the lower holder, a calculator for calculating a mismatch amount for the patterns according to signals detected by the sensor and a controller for controlling the moving device and the rotator according to the mismatch amount. The lower work piece is moved and rotated with the lower holder and the patterns of two work pieces are matched. After the work pieces are matched and set, a carrying device carries the work pieces to a sewing position from a setting position on a work table.

20 Claims, 11 Drawing Sheets

35
18
13
10
P
W
67
80

WORK PIECE SETTING APPARATUS WITH PATTERN MATCHING

BACKGROUND OF THE INVENTION

This invention relates to a work piece setting apparatus for attaching two work pieces, each having similar patterns with the patterns matching.

In prior-art sewing machines, a pocket patch is stitched on a body cloth as follows.

Before stitching, an operator holds the pocket patch above a table with a pocket setter, puts the body cloth on the table, and manually moves the body cloth on the table to match positions between the pocket patch and the body cloth. This method has some disadvantages. Especially when the body cloth and the pocket patch have the same pattern, the manual pattern-matching operation causes eye-fatigue for the operator, which lowers worker efficiency. Furthermore, pattern mismatching occurs since great skill for matching the patterns is required.

SUMMARY OF THE INVENTION

One object of this invention is to provide a work piece setting apparatus for setting two work pieces with the similar patterns so that their patterns are easily and accurately matched.

Another object of this invention is to provide a work piece setting apparatus combined with a work piece attaching device for attaching two superposed work pieces to each other with their patterns matching.

According to this invention, work piece setting apparatus for setting one patterned work piece on another patterned work piece with the patterns of the two work pieces matching, comprises: a detecting device for detecting patterns on both work pieces; a moving device for moving at least one of the work pieces along at least one axis on a plane; a rotating device for rotating at least one of the work pieces around an axis perpendicular to the plane; a calculating device for calculating a mismatch amount of the patterns detected by the detecting means; and a control device for controlling both the moving means and the rotating means according to the mismatch amount and for correcting a relative position between the work pieces. Furthermore, the work piece setting apparatus combined with the work piece attaching device sets two work pieces at a setting position on a work table. A superposing device superposes the two work pieces with their patterns matching. Then a carrying device carries the two superposed work pieces to an attaching position where an attaching device attaches the two superposed work pieces to each other.

DETAILED DESCRIPTION OF THE PREFERRED EMBODIMENT

Figure 2:
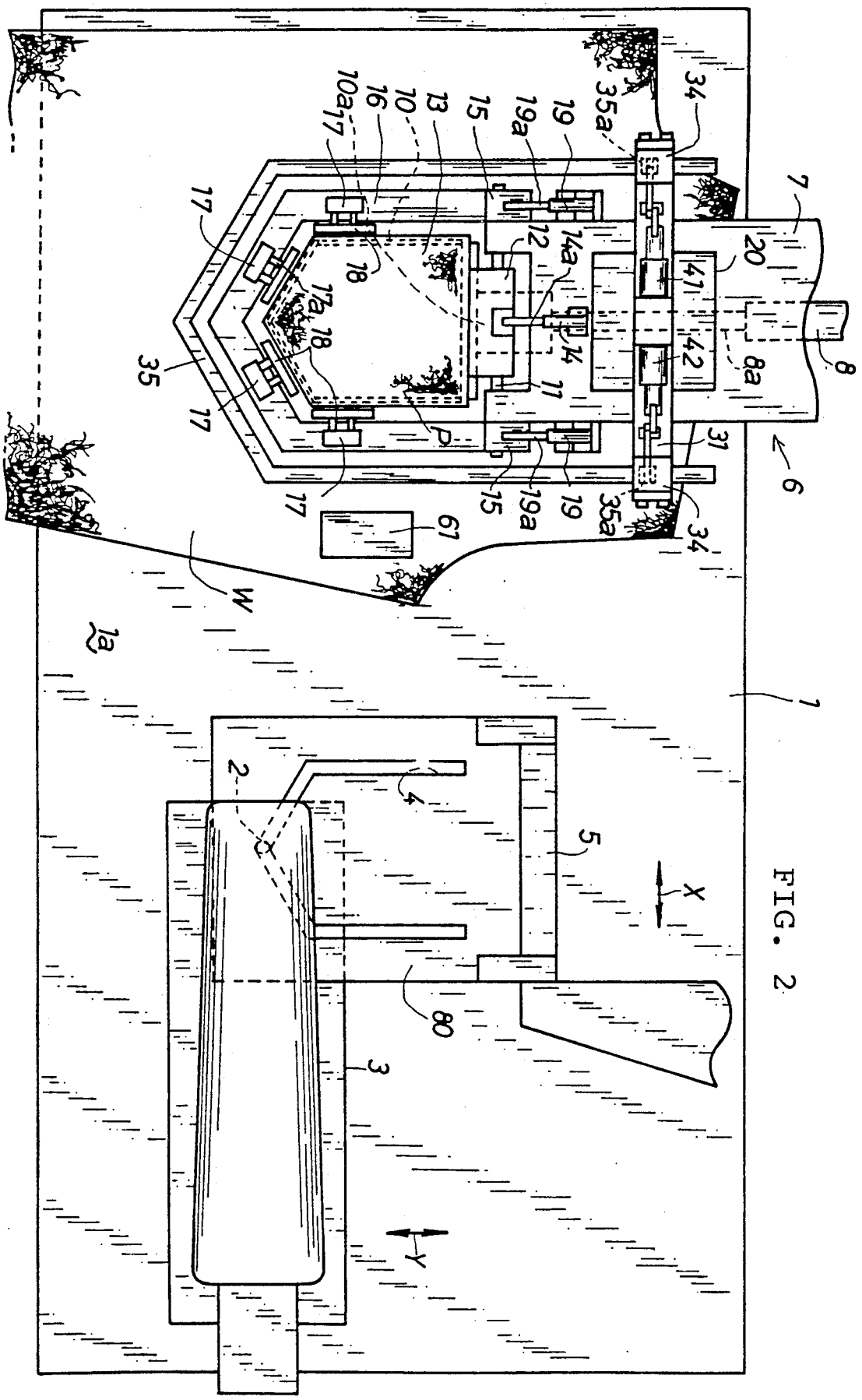
FIG. 2 is a plan view of the sewing machine.
Figure 3:
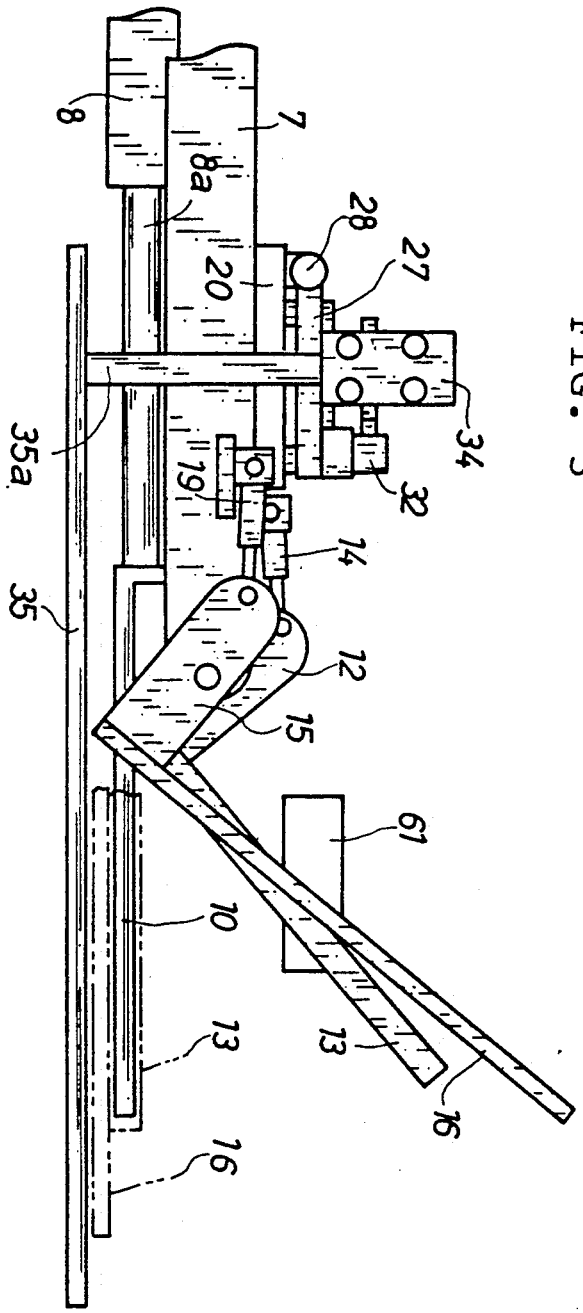
FIG. 3 is a side view of a pocket setter of the sewing machine.
Figures 6A, 6B, 6C:
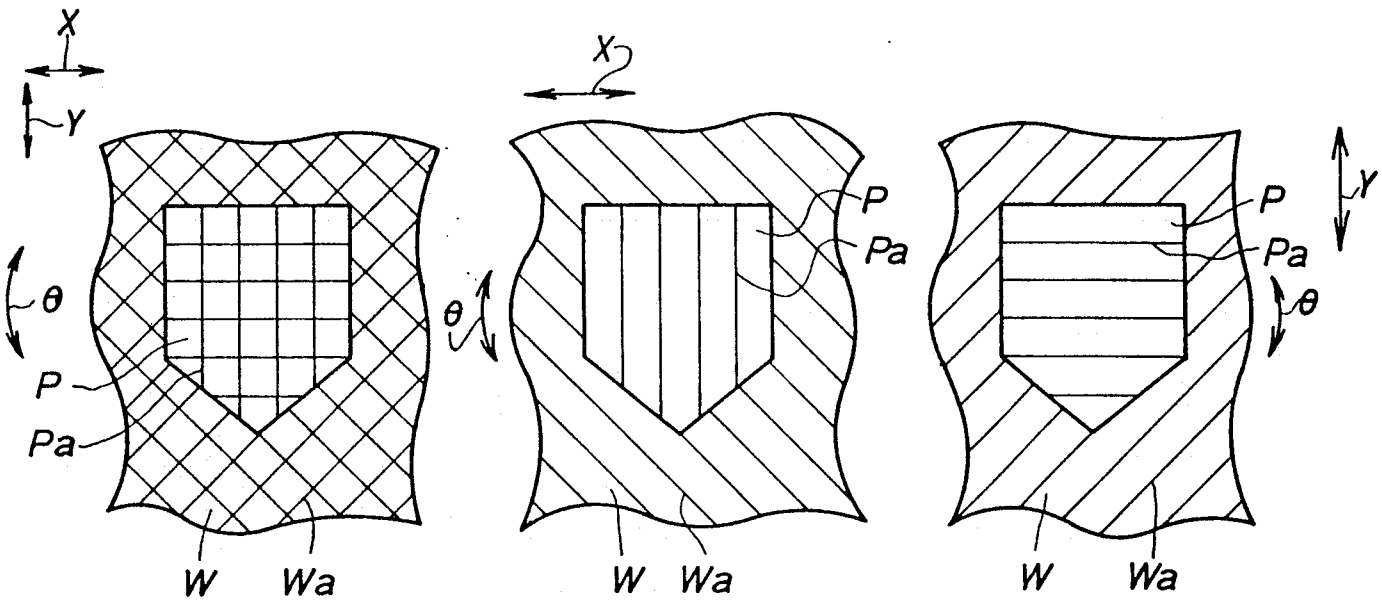
FIG. 6A illustrates a body cloth and a pocket patch, both having a plaid stripe pattern.
FIG. 6B illustrates a body cloth and a pocket patch, both having a vertical stripe pattern.
FIG. 6C illustrates a body cloth and a pocket patch, both having a horizontal stripe pattern.

As shown in FIG. 2, a sewing machine 3, which has a stitch forming mechanism including a needle 2 and a loop taker (not shown), is installed on the right side of a table 1, and moves along the Y-axis. A work holder 5 supports a removable base plate 80 with a needle guide groove 4, and moves along the X-axis. The work holder 5 and the sewing machine 3 move along X-axis and Y-axis, respectively, so that the needle 2 is moved along the needle guide groove 4, and the body cloth W and the pocket patch P are stitched together by the sewing machine 3. The body cloth W and the pocket patch P have the similar patterns, Wa and Pa, respectively, such as a plaid stripe pattern (FIG. 6A), a vertical stripe pattern (FIG. 6B), or a horizontal stripe pattern (FIG. 6C).

A pocket setter 6 is installed at a preparatory position on the left side of the table 1. The pocket setter 6 includes a supporting member 7 that moves up and down along a vertical axis. A removable gauge plate 10, on which the pocket patch P is set for determining the contour of the pocket patch P, is attached through a gauge plate supporter 10*a* to a piston 8*a* of an air cylinder 8 on the lower surface of the supporting member 7.

A rotatable holding-plate supporter 12 is attached to an axis 11 that extends horizontally through a front portion of the supporting member 7. A removable holding plate 13 attached to the holding-plate supporter 12 folds the peripheral edges of the pocket patch P downward along the contour of the gauge plate 10. The holding-plate supporter 12 is connected to a piston 14*a* of an air cylinder 14 that rotatably connects to the upper surface of the supporting member 7.

A removable U-shaped folder supporter 16 is attached to a pair of supporting blocks 15 that pivotably attach to both ends of the axis 11. Front end of the holding plate 13 is surrounded by four cylinders 17 with pistons 17*a*. Each of the pistons 17*a* is equipped with a folder 18 for folding back the peripheral edges of the pocket patch P folded downward by the holding plate 13, along the back surface of the gauge plate 10. A pair of air cylinders 19 with pistons 19*a* rotatably connect to the both sides of the supporting member 7, and the pistons 19*a* connect to the upper ends of the supporting blocks 15.

U.S. patent application No. 181,531 filed on Apr. 14, 1988 now U.S. Pat. No. 4,883,006 discloses a construction in which the sewing machine 3 moves along the Y-axis, and the work holder 5 moves along the X-axis between the preparatory position and a stitching position opposite to the needle 2, and also discloses a construction for operating the pocket setter 6 including the gauge plate 10, the holding plate 13, the folder supporter 16 and the folders 18. Therefore, a detailed explanation about these structures is omitted.

Figure 4:
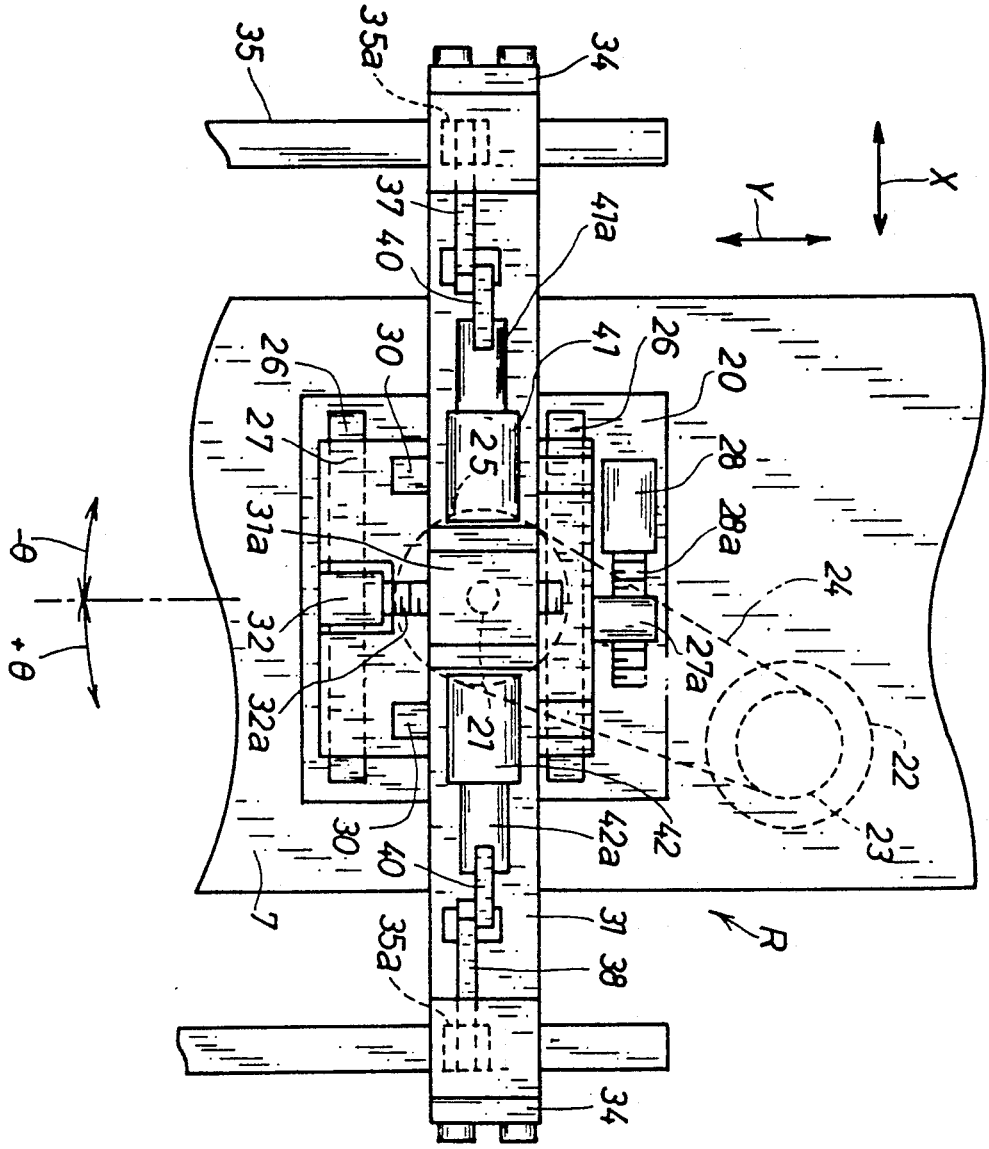
FIG. 4 is a slightly enlarged plan view illustrating a pattern-matching mechanism of the pocket setter.
Figure 5:
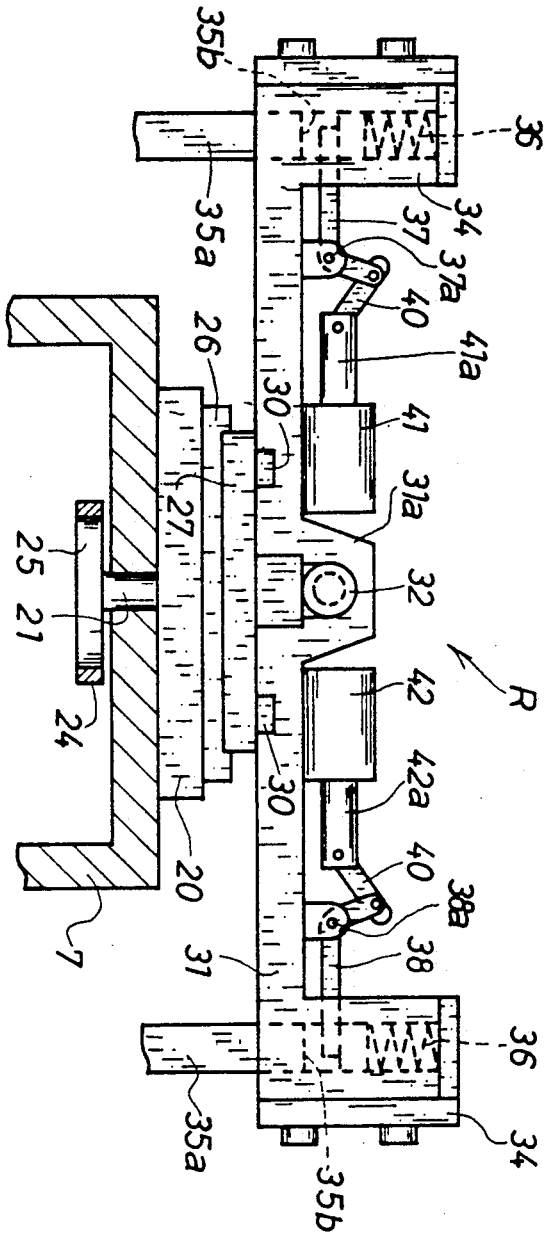
FIG. 5 is a sectional view of the pattern-matching mechanism.

As shown in FIGS. 2 through 5, a main supporter 20 is placed on the front upper surface of the supporting member 7. In FIG. 5, an axis 21 projects from the center of the lower surface of the main supporter 20 through the supporting member 7. In FIG. 4, a $\theta$-axis pulse motor 22 is provided at the rear portion of the main supporter 20, and a driving pulley 23 on an output shaft of the motor 22 connects through a belt 24 to a driven pulley 25 on the axis 21.

A pair of guide rails 26 projects parallel to the X-axis from the main supporting plate 20. A first sub-supporter 27 slides along the pair of guide rails 26. An X-axis pulse motor 28 is provided at the rear portion of the first sub-supporter 27 on the main supporter 20. The first sub-supporter 27 has a connecting nut 27*a* that projects rearward. A screw-like output shaft 28*a* of the X-axis pulse motor 28 engages with the connecting nut 27*a*.

A pair of guide rails 30 projects parallel to the Y-axis from the upper surface of the first sub-supporter 27. A second sub-supporter 31 slides along the pair of guide rails 30. A Y-axis pulse motor 32 is placed at the front portion of the second sub-supporter 31 on the first sub-supporter 27. A tapped protrusion 31*a* at the center of the upper surface of the second sub-supporter 31 engages with a screw-like output shaft 32*a* of the Y-axis pulse motor 32.

In FIG. 2, a vertically movable U-shaped clamp 35, which surrounds the periphery of the folder supporter 16, is supported by both end supporters 34 of the second sub-supporter 31. The clamp 35, which has two support ends 35*a* that project upward from the clamp 35, is lowered by actuating springs 36 within the end supporters 34, as shown in FIG. 5. A pair of levers 37 and 38 at the both ends of the upper surface of the second sub-supporter 31 rotate about pivot points 37*a* and 38*a*, respectively. One end of each of the levers 37 and 38 engages with a hole 35*b* on the support end 35*a* of the clamp 35, and the other end connects via a link 40 to either of pistons 41*a* and 42*a* of air cylinders 41 and 42. When the pistons 41*a* and 42*a* are pulled in, the clamp 35 moves up against the springs 36. On the other hand, when the air cylinders 41 and 42 are not operated, the clamp 35 moves down with the help of the springs 36, thus fixing the body cloth W on the surface 1*a* of the table 1 in FIG. 2.

In this embodiment, when the supporting member 7 is at a waiting position above the table 1, and the gauge plate 10 is above the body cloth W, the pistons 41*a* and 42*a* are compressed by the springs 36, and the clamp 35 fixes the body cloth W on the surface 1*a*. The body cloth W fixed by the clamp 35 moves along the Y-axis with the second sub-supporter 31 according to the rotation of the output shaft 32*a* of the pulse motor 32, and moves along the X-axis with the sub-supporters 27 and 28 according to the rotation of the output shaft 28*a* of the pulse motor 28. Further, the body cloth W is rotated around the axis 21 with the main supporter 20 and the sub-supporters 27 and 31 according to the rotation of the pulse motor 22.

In this embodiment, a relative movement mechanism R is constructed by the motors 22, 28, and 32, the main supporter 20, the first and second sub-supporters 27 and 31, and the clamp 35 to generate relative movement between the body cloth W and the pocket patch P.

Figure 1:
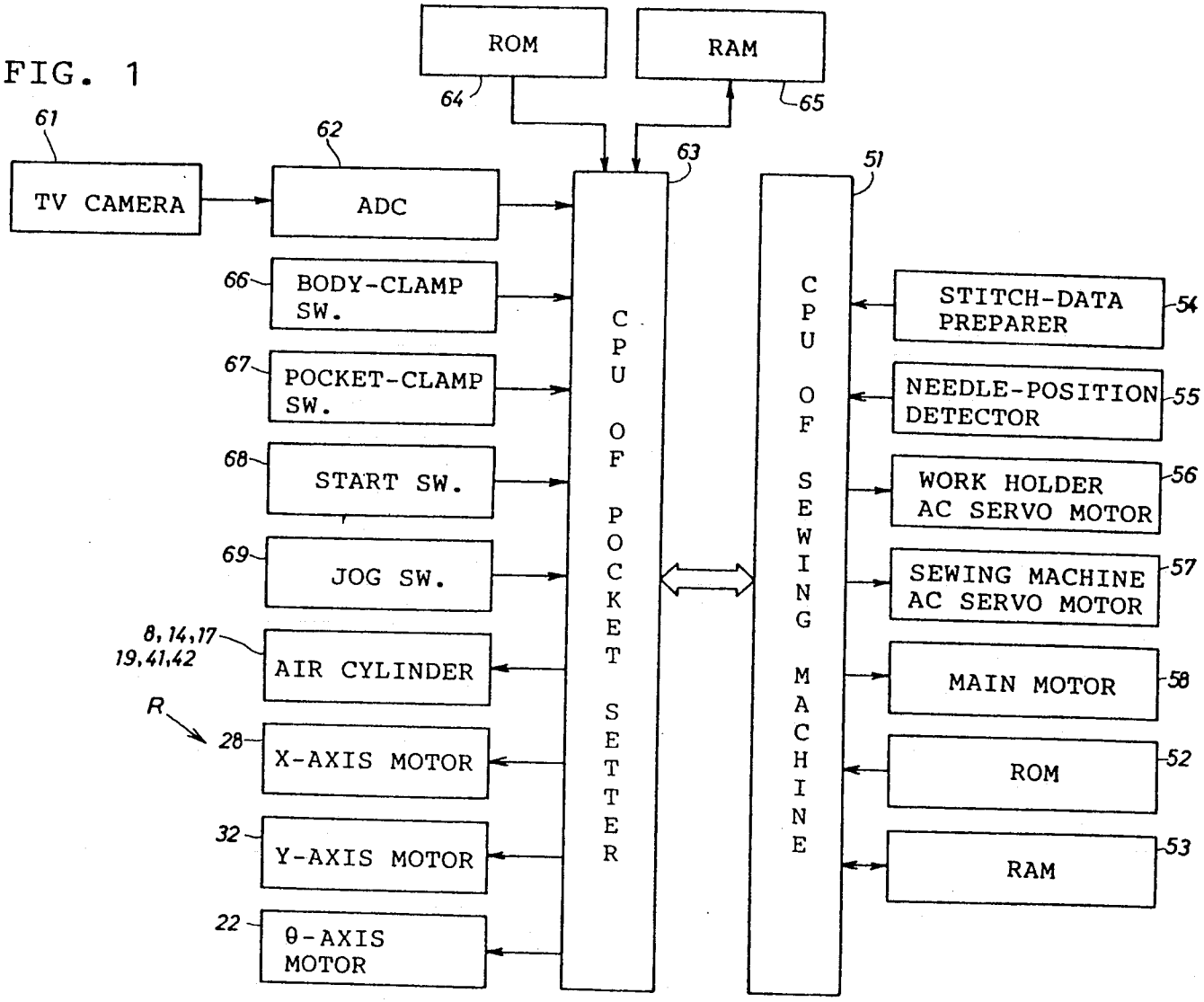
FIG. 1 is a block diagram illustrating a control circuit of a sewing machine embodying this invention.

As shown in FIG. 1, the sewing machine 3 has a central processing unit (CPU) 51 that connects to read-only memory (ROM) 52 and random-access memory (RAM) 53. The CPU 51 connects to a stitch-data preparer 54 for the pocket patch P, and to an upper-and-lower needle position detector 55. The CPU 51, further, connects through a motor driver (not shown) to AC servo motors 56 and 57 for moving the work holder 5 and the sewing machine 3 along the X-axis and the Y-axis, respectively. The CPU 51 sends signals to the motors 56 and 57 in response to signals from the preparer 54 and the detector 55. Furthermore, the CPU 51 connects through the motor driver (not shown) to a main motor 58, and sends signals to the main motor 58 to operate the stitch forming mechanism in response to signals from the preparer 54 and the detector 55.

A TV camera 61 (FIGS. 2 and 3) is provided at one upper side of the pocket setter 6 for taking pictures of the patterns Wa and Pa. The pocket setter 6 has a central processing unit (CPU) 63 that receives image data sent from the TV camera 61 through an analog-digital converter (ADC) 62.

The CPU 63 connects to read-only memory (ROM) 64, random-access memory (RAM) 65, a body-clamp switch 66 for fixing the body cloth W on the surface 1*a* with the clamp 35, a pocket-clamp switch 67 for fixing the pocket patch P on the gauge plate 10 with the holding plate 13, a start switch 68 for moving the body cloth from the preparatory position to the stitching position of the sewing machine 3, and the air cylinders 8, 14, 17, 19, 41, and 42, which are controlled in response to signals from the switches 66, 67, and 68.

Further, the CPU 63 connects through the motor driver (not shown) to the $\theta$-axis pulse motor 22, the X-axis pulse motor 28, the Y-axis pulse motor 32, and six jog switches 69 for moving the body cloth W by a preset amount ($\pm\Delta\theta$, $\pm\Delta x$, and $\pm\Delta y$) around the $\theta$-axis, and along the X-axis and the Y-axis, respectively. The CPU 63 drives the motors 22, 28, and 32 based on image data from the TV camera 61 and signals from the jog switches 69.

The operation of the pocket setter 6 is now explained with reference to FIGS. 7A through 7D and FIGS. 8A through 8J.

Before setting the pocket patch P and the body cloth W, the supporting member 7 is set at the waiting position above the table 1, the gauge plate 10 is laid under the supporting member 7, and the holding plate 13, folder supporting plate 16 and clamp 35 are set at their upper positions.

Figure 7A:
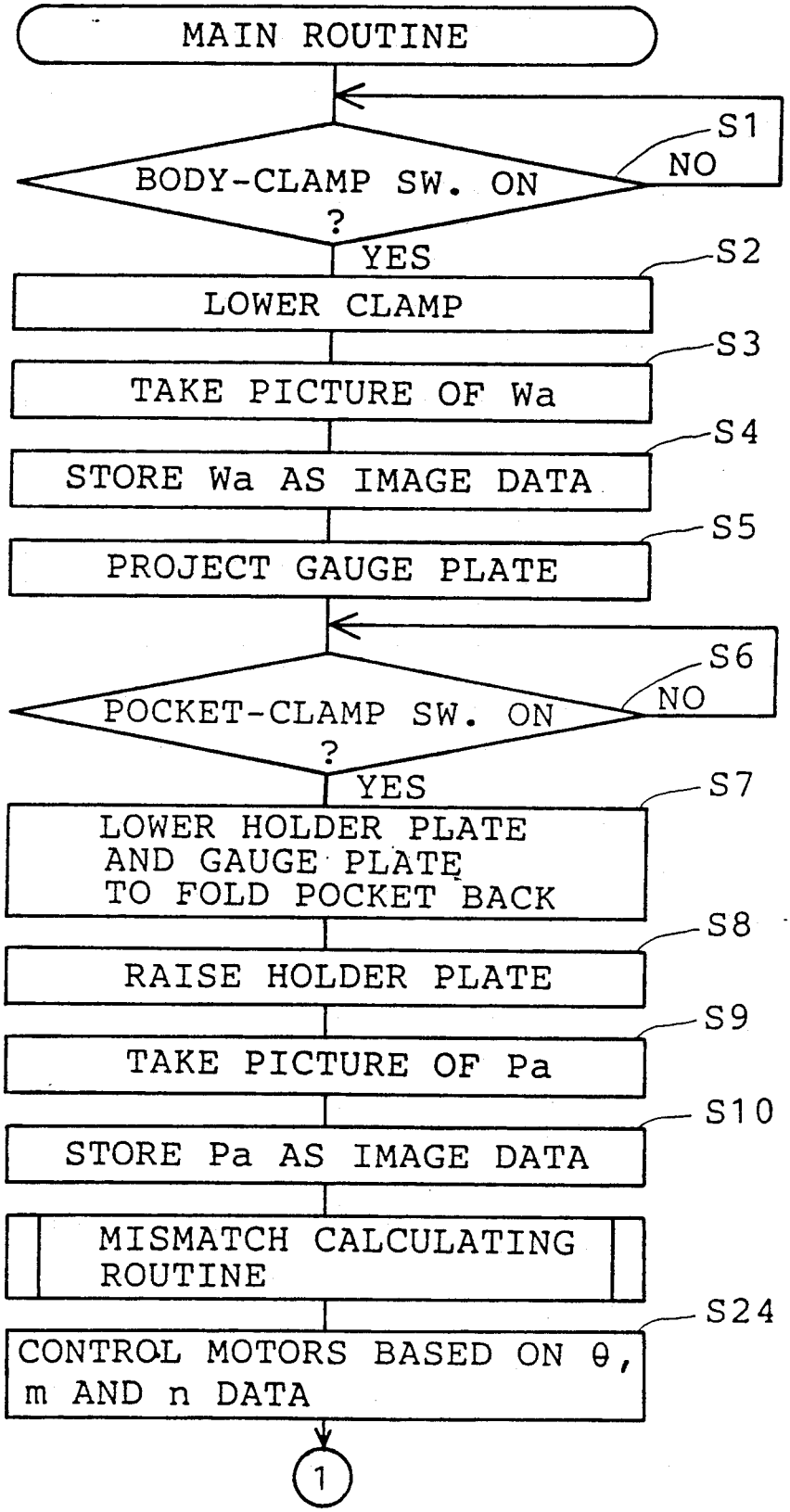
FIGS. 7A and 7C are flow charts for a main routine that explains the process for fixing the pocket patch on the body cloth with their patterns matching.
Figure 7B:
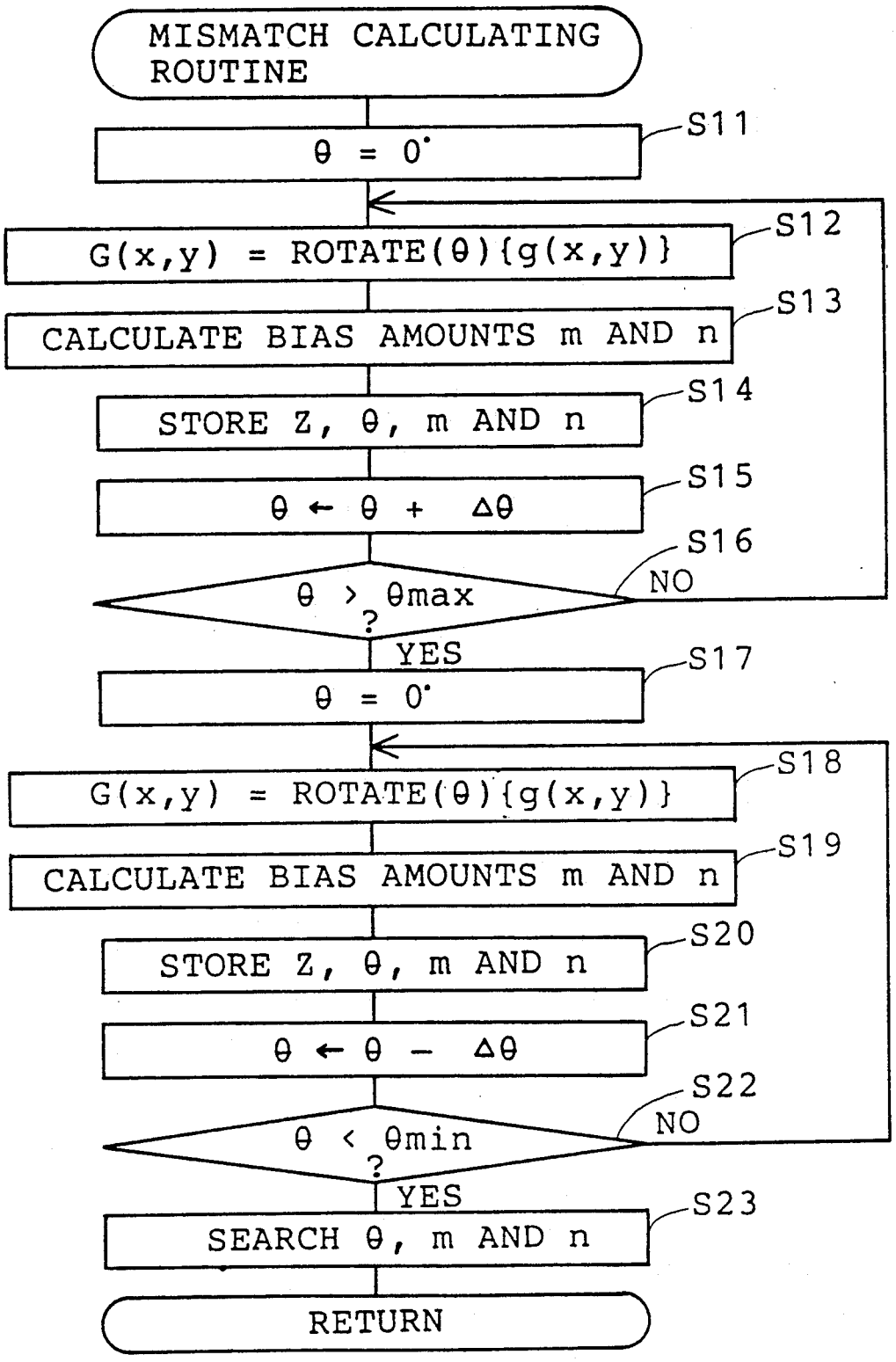
FIG. 7B is a flowchart for the mismatch calculating routine.
Figures 8A, 8B, 8C, 8D, 8E, 8F, 8G, 8H, 8I, 8J:
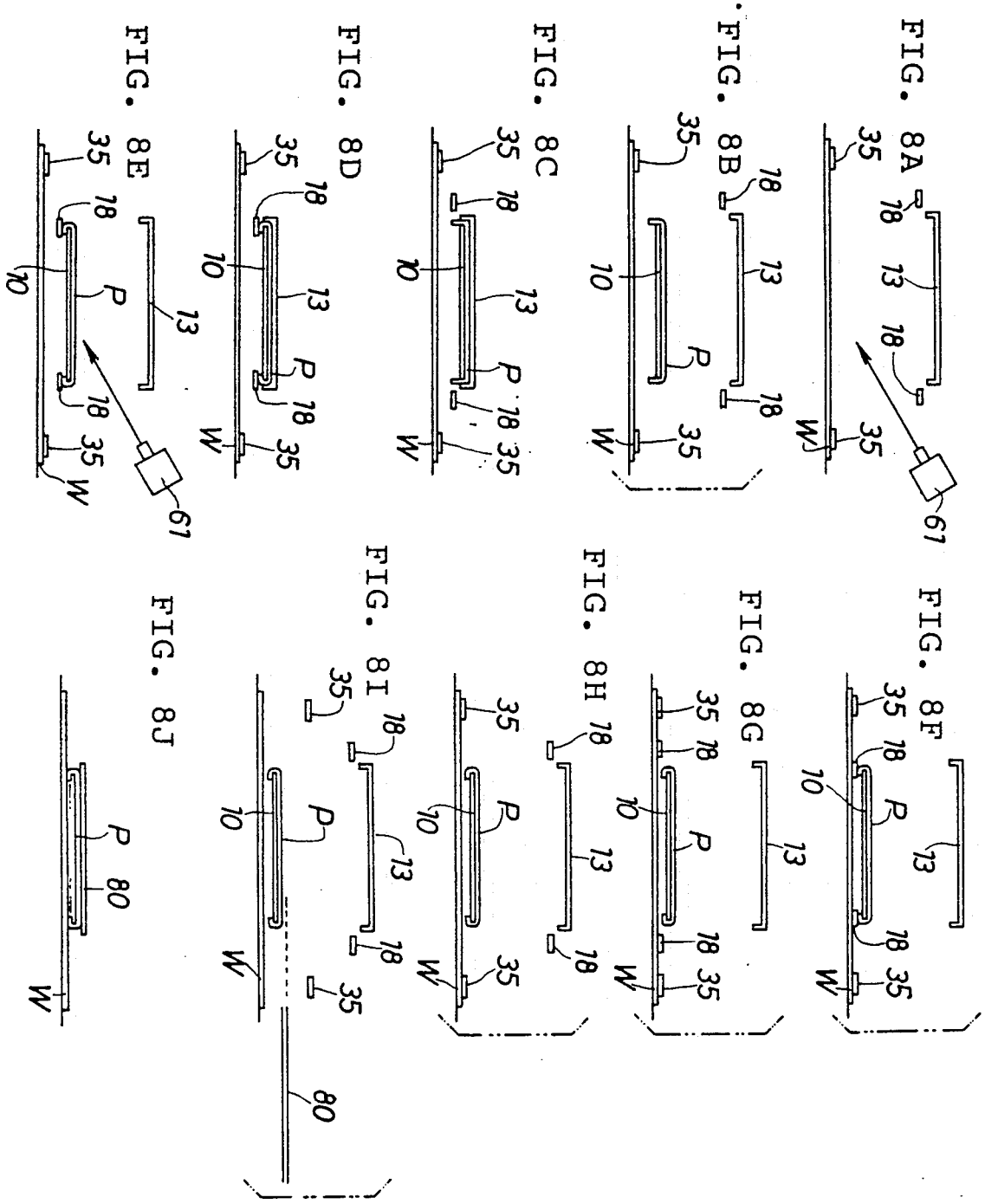
FIGS. 8A through 8J illustrate the steps of the process for fixing the pocket patch on the body cloth with their patterns matching.

As shown in FIG. 7A, when the body cloth W is supplied under the clamp 35, it is determined at step S1 whether the clamp switch 66 is turned on. If the result is YES, the CPU 63 drives the air cylinders 41 and 42 at step S2 to lower the clamp 35 for holding the body cloth W on the surface 1*a* (FIG. 8A). The CPU 63 operates the TV camera 61 at step S3 to take a picture of the pattern Wa and stores the pattern Wa as image data in the RAM 65 at step S4. The CPU 63 drives the air cylinder 8 at step S5 to project the gauge plate 10 forward (FIG. 8B). After the pocket patch P is laid on the gauge plate 10, it is determined at step S6 whether the clamp switch 67 is turned on. If the result is YES, the CPU 63 lowers the holder plate 13 and the folder supporter 16 as indicated by the broken line in FIG. 3, and then projects the folders 18 to fold back the peripheral edge of the pocket patch P along the contour of the gauge plate 10 at step S7 (FIGS. 8C and 8D).

The CPU 63 raises the holder plate 13 at step S8, operates the TV camera 61 to take a picture of the pattern Pa of the pocket patch P at step S9 (FIG. 8E), and stores the pattern Pa as image data in the RAM 65 at step S10. Then, the program goes to the mismatch calculating routine shown in FIG. 7B for calculating mismatch distance for the patterns Wa and Pa. The rotation angle $\theta$ is set to zero at step S11, and the CPU 63 calculates equation (1) at step S12.

$$G(x,y)=ROTATE\ (\theta)\cdot[g(x,y)] \quad (1)$$

in which g(x,y) is the y for the pattern Wa of the body cloth W at a coordinate (x,y), and G(x,y) is the light intensity at the position where the coordinate (x,y) is rotated by a preset angle $\theta$ about the rotary axis 21 of the main supporter 20.

The CPU calculates equation (2) at step S13.

$$Z(m,n) = \int_{y1}^{y2} \int_{x1}^{x2} [f(x-m,y-n) - G(x,y)]^2 dx \cdot dy \quad (2)$$

in which f(x,y) is the light intensity for the pattern Pa of the pocket patch P at a coordinate (x,y), and Z is a correlation function. In the correlation function, Z(m,n) is a matching ratio of the patterns Pa and Wa within ranges $x1 \leqq x \leqq x2$ and $y1 \leqq y \leqq y2$, and m and n are parameters. The values x1, x2, y1, and y2 are preset within the area where the clamp 35 can move without contacting with the supporting member 7. When the value of Z reaches its minimum, the bias amounts m and n are calculated, and each value of Z, m, n, and $\theta$ is stored in the RAM 65 at step S14. The values m and n are mismatch distances along the X-axis and the Y-axis for the patterns Wa and Pa, respectively. Next, the CPU 63 increases the rotation angle $\theta$ by a preset rotation angle $\Delta\theta$ at step S15. It is determined at step S16 whether the rotation angle $\theta$ exceeds the maximum rotation angle $\theta$max in the positive $\theta$-direction, which is determined by mechanical capacity. The process of steps S12 through S16 is repeated until the result in step S16 is YES, thus calculating each value of Z, m, n, and $\theta$ in the case where the clamp 35 is rotated by $\Delta\theta$ in the positive $\theta$-direction.

On the other hand, in steps S17 through S22, the CPU 63 executes the subtraction process for the rotation angle $\theta$. The subtraction process is repeated until the rotation angle $\theta$ is less than the minimum rotation angle $\theta$min in the negative $\theta$-direction, thus calculating each value of Z, m, n, and $\theta$ in the case where the clamp 35 is rotated by $\Delta\theta$ in the negative $\theta$-direction.

At step S23, the CPU 63 searches the values m, n, and $\theta$ corresponding to the minimum value of Z, and sets the values m, n, and $\theta$ as mismatch-distance data for the patterns Wa and Pa. Then, the program returns to step S24 of the main routine (FIG. 7A), where the CPU 63 drives the pulse motors 22, 28, and 32 based on the mismatch-distance data. Thus, the body cloth W is moved with the clamp 35 along the X-axis and the Y-axis, and around the $\theta$ axis to match the body cloth pattern Wa with the pocket patch pattern Pa.

Figure 7C:
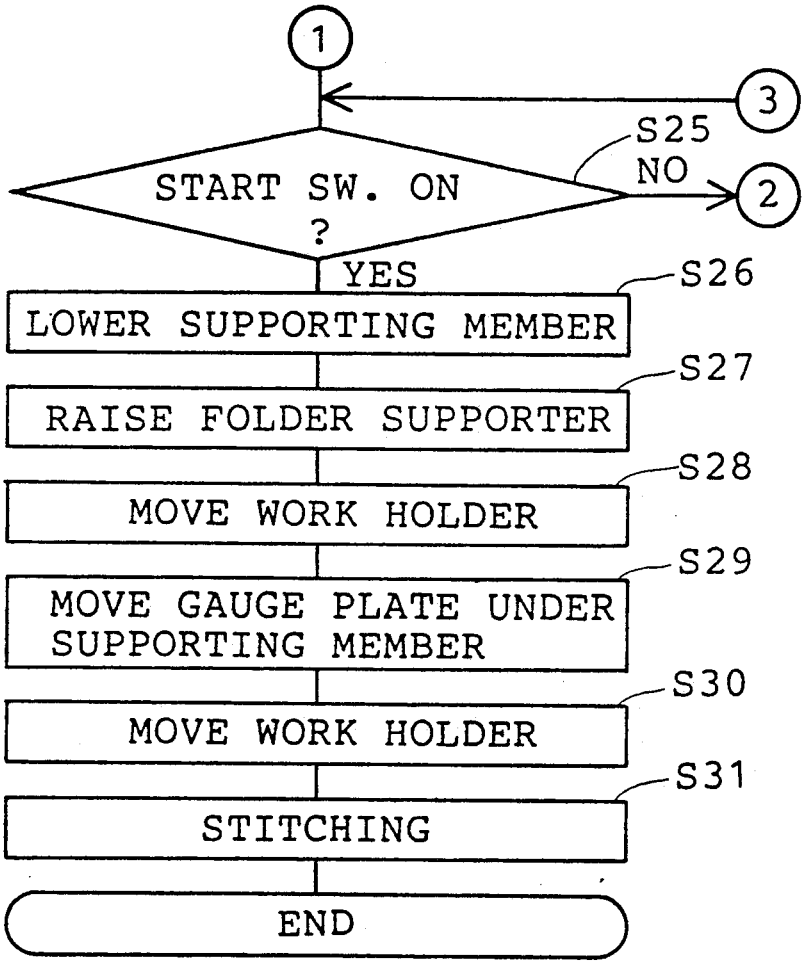

As shown in FIG. 7C, when the start switch 68 is turned on at step S25, the CPU 63 lowers the supporting member 7 against the springs 36 that actuate the clamp 35, and brings the gauge plate 10, the folder supporter 16, and the pocket patch P close to the body cloth W at step S26 (FIG. 8F). Next, the CPU 63 separates each folder 18 from the pocket patch P, and raises the folder supporter 16 from the pocket patch P at step S27 (FIGS. 8G and 8H). During this time, the gauge plate 10 is pressing the pocket patch P onto the body cloth W.

When the clamp 35 and the needle 2 are raised, the CPU 63 drives the AC servo motor 56 through the CPU 51 to move the base plate 80 with the work holder 5 above the gauge plate 10 (FIG. 8I). The work holder 5 presses the pocket patch P on the body cloth W in cooperation with the gauge plate 10 at step S28. The CPU 63 separates the gauge plate 10 from the pocket patch P to lay the gauge plate 10 under the supporting member 7 at step S29 (FIG. 8J).

The CPU 63 returns the base plate 80 with the work holder 5 to the stitching point by means of the CPU 51 at step S30 together with the pocket patch P and the body cloth W that are pressed on the surface 1a by the work holder 5. At this time, the supporting member 7 is moved to the waiting position, and the pocket setter 6 is initialized. The CPU 51 reads stitch pattern data from the RAM 53, and drives the motors 56, 57, and 58 based on the stitch pattern data to stitch the pocket patch P onto the body cloth W at step S31. Then, the main routine ends.

Figure 7D:
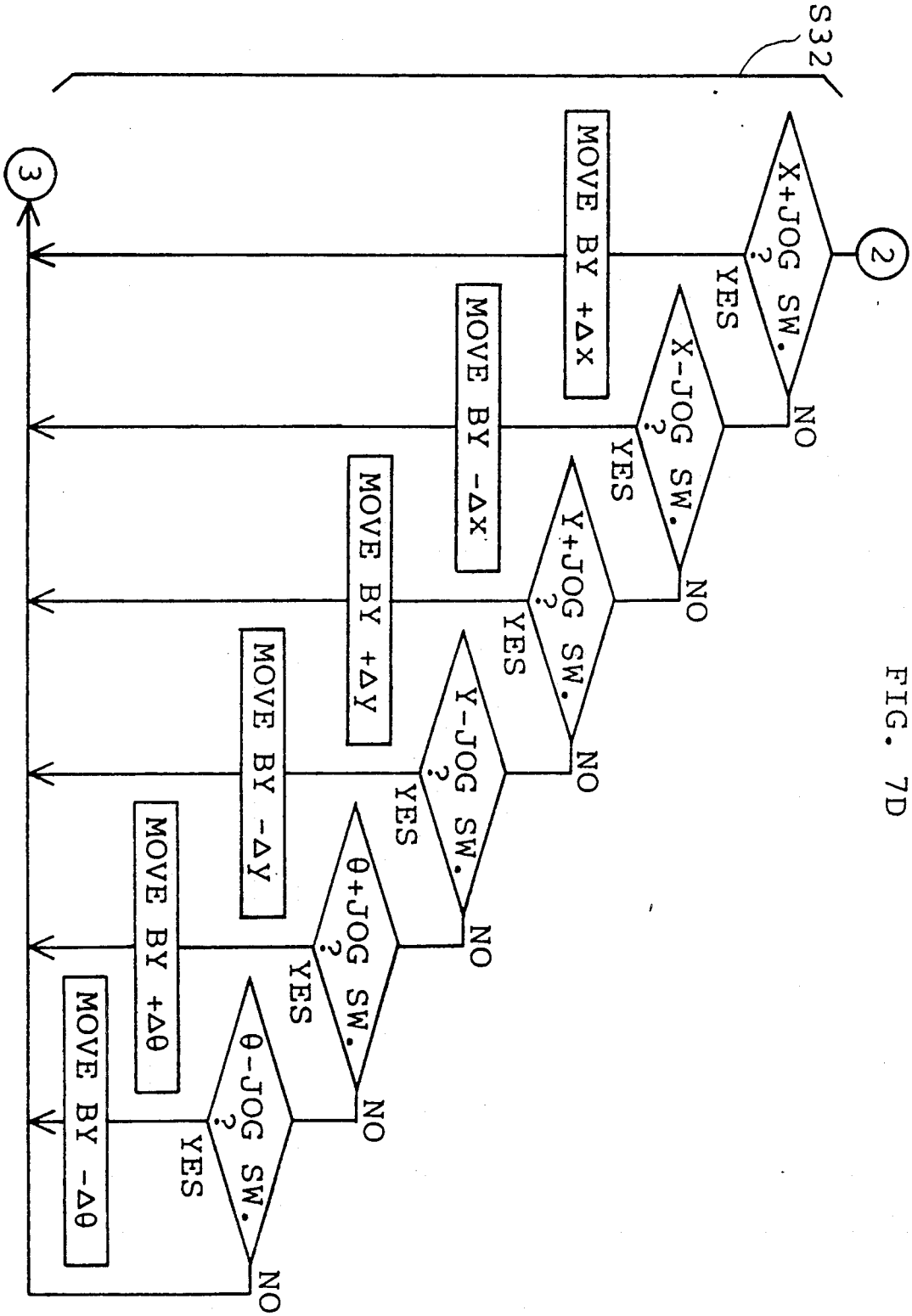
FIG. 7D is a flowchart explaining how fine adjustments are made using jog switches.

Since there is a trade-off between the resolution of the TV camera 61 and fineness of patterns, automatic pattern matching might not produce a satisfactory result. As shown in FIG. 7D, when the jog switches 69 are operated before the operation of the start switch 68, the CPU 63 moves the clamp 35 by the preset amounts $\pm\Delta x$, $\pm\Delta y$ and $\pm\Delta\theta$ in each direction according to the operated jog switches 69. In this way, the operator can finely match the patterns at step S32 while confirming the patterns Wa and Pa visually.

As explained above, in this embodiment, the body cloth W is moved along the X-axis and the Y-axis, and around the $\theta$-axis to match the patterns Wa and Pa, so that even complicated patterns such as a plaid can be matched accurately without any special skill. Furthermore, since the body cloth W is moved for pattern matching, the position of the pocket patch P remains constant, so no troublesome adjustment of the stitch pattern data representing the relative position between the work holder 5 and the needle 2 is required every time the relative position of the pocket patch P changes.

The present invention is not restricted to this embodiment. The following modifications and variations are also possible.

(a) When matching the patterns Pa and Wa with vertical or horizontal stripes (FIGS. 6B and 6C), the clamp 35 may be rotated around the $\theta$-axis and be moved along either the X-axis or the Y-axis corresponding to the direction of the stripe. Specifically, in the case of the vertical stripe (FIG. 6B), the clamp 35 is rotated around the $\theta$-axis, and is moved along the X-axis for pattern matching. On the other hand, in the case of the horizontal stripe (FIG. 6C), the clamp 35 is rotated around the $\theta$-axis and is moved along the Y-axis. A selection switch may be used for selecting a moving direction of the clamp 35 corresponding to a vertical or a horizontal stripe, and for determining two mismatch-distances: distances: one for the $\theta$-axis, and one for either the X-axis or the Y-axis. In this case, the calculating speed increases compared with the case where three mismatch distances are calculated as described above.

(b) The pocket patch P may be moved when matching the patterns Pa and Wa.

(c) Both the body cloth W and the pocket patch P may be moved when matching the patterns Pa and Wa.

(d) As described in U.S. Pat. No. 4,412,640, for example, rivets may be used for fixing two cloths.

(e) Adhesive agents may be used for fixing two cloths.

What is claimed is:

1. A work piece setting apparatus for setting one patterned work piece on another patterned work piece so that the pattern of one work piece has a predetermined relationship to the pattern on the other work piece, comprising:

detecting means for detecting patterns on both work pieces;

moving means for moving at least one of the work pieces along at least one axis on a plane;

rotating means for rotating at least one of the work pieces around an axis perpendicular to the plane;

calculating means for calculating a mismatch distance and a mismatch angle based on the patterns detected by the detecting means; and control means for controlling both the moving means and the rotating means according to the mismatch distance and the mismatch angle to correct a relative relationship between the patterns on the work pieces.

2. A work piece setting apparatus according to claim 1, in which the mismatch distance is a distance between the patterns along at least one moving means axis on the plane and the mismatch angle is an angle between the patterns around the axis perpendicular to the plane.

3. A work piece setting apparatus according to claim 1, in which the moving means moves at least one of the work pieces along two perpendicular axis on the plane.

4. A work piece setting apparatus according to claim 3, in which the calculating means calculates mismatch distances between the patterns along each of the two perpendicular axes on the plane and the mismatch angle is an angle between the patterns around the axis perpendicular to the plane.

5. A work piece setting apparatus according to claim 1, further comprising:

first work piece holding means for holding one of the work pieces;

second work piece holding means for holding the other work piece, and for moving vertically to the first work piece holding means; in which the moving means moves at least one of the holding means, and the rotating means rotates at least one of the holding means.

6. A work piece setting apparatus according to claim 5, in which the moving means moves at least one of the holding means along two perpendicular axes on the plane.

7. A work piece setting apparatus according to claim 5, in which the moving means moves the first work piece holding means and the rotating means rotates the first work piece holding means.

8. A work piece setting apparatus according to claim 6, in which the moving means moves the first work piece holding means and the rotating means rotates the first work piece holding means.

9. A work piece setting apparatus according to claim 7, further comprising a folding means for folding back peripheral edges of the work piece held by the second work piece holding means.

10. A work piece setting apparatus according to claim 8, further comprising folding means for folding back peripheral edges of the work piece held by the second work piece holding means.

11. A work piece setting apparatus for setting one patterned work piece on another patterned work piece so that the pattern of one work piece has a predetermined relationship to the pattern on the other work piece, comprising:

lower work piece holding means for holding a lower work piece at a setting position on a work table;

upper work piece holding means for holding an upper work piece, the upper work piece holding means moving vertically from the work table at the setting position;

detecting means for detecting patterns on both work pieces;

moving means for moving at least one of the work pieces along at least one axis of the work table;

rotating means for rotating at least one of the work pieces around an axis perpendicular to the work table;

calculating means for calculating a mismatch distance and a mismatch angle based on the patterns detected by the detecting means;

control means for controlling both the moving means and the rotating means according to the mismatch distance and the mismatch angle to correct a relative relationship between the patterns on the work pieces;

superposing means for superposing the upper work piece over the lower work piece; and carrying means for carrying the superposed work pieces to a fixing position from the setting position on the work table.

12. A work piece setting apparatus according to claim 11, in which the mismatch distance is a distance between the patterns along at least one moving means axis on the work table and the mismatch angle is an angle between the patterns around the axis perpendicular to the work table.

13. A work piece setting apparatus according to claim 11, in which the moving means moves the lower work piece holding means along two perpendicular axes on the work table.

14. A work piece setting apparatus according to claim 13, in which the calculating means calculates mismatches distances between the patterns along each of the two perpendicular axes on the work table and the mismatch angle is an angle between the patterns around the axis perpendicular to the work table.

15. A work piece setting apparatus according to claim 11, further comprising folding means for folding back peripheral edges of the upper work piece held by the upper work piece holding means at the setting position.

16. A work piece setting apparatus according to claim 13, further comprising folding means for folding back peripheral edges of the work piece held by the upper work piece holding means at the setting position.

17. A work piece setting and attaching apparatus for setting one patterned work piece on another patterned work piece so that the pattern of one work piece has a predetermined relative position to a pattern on the other work piece, comprising:

lower work piece holding means for holding a lower work piece at a setting position on a work table;

upper work piece holding means for holding an upper work piece, the upper work piece holding means moving vertically from the work table at the setting position;

detecting means for detecting patterns on both work pieces;

moving means for moving the lower work piece holding means along at least one axis on the work table;

rotating means for rotating the lower work piece holding means around an axis perpendicular to the work table;

calculating means for calculating a mismatch amount of the patterns detected by the detecting means;

control means for controlling both the moving means and the rotating means according to the mismatch amount of the patterns and for correcting a relative position between the two work pieces;

superposing means for superposing the upper work piece over the lower work piece; and carrying means for carrying the superposed work pieces to an attaching position from the setting position on the work table; and attaching means for attaching the superposed work pieces to each other at the attaching position.

18. A work piece setting and attaching apparatus according to claim 17, in which the calculating means calculates a mismatch distance between the patterns along at least one moving-means axis on the work table and a mismatch angle between the patterns around the axis perpendicular to the work table as the mismatch amount.

19. A work piece setting and attaching apparatus according to claim 17, in which the attaching means is a sewing device, and the work piece setting and attaching apparatus further comprises position changing means for changing the relative position between the work pieces and the sewing device according to a sewing program stored in memory means.

20. A work piece setting apparatus according to claim 1, further comprising:

first adjusting means for moving at least one of the work pieces along at least one axis on the plane by a preset amount and for adjusting relative positions between the work pieces along the axis on the plane; and second adjusting means for rotating at least one of the work pieces around the axis perpendicular to the plane by a preset amount and for adjusting relative positions between the work pieces around the axis perpendicular to the plane.

* * * * *